US006102153A

United States Patent [19]

Willke, Jr.

[11] Patent Number: 6,102,153

[45] Date of Patent: Aug. 15, 2000

[54] COMPACT AIR HANDLING UNIT WITH INTEGRAL SILENCING

[76] Inventor: Herbert L. Willke, Jr., 55 Magazine St. #18, Cambridge, Mass. 02238

[21] Appl. No.: 09/318,858

[22] Filed: May 26, 1999

Related U.S. Application Data

[60] Provisional application No. 60/087,703, Jun. 2, 1998.

[51] Int. Cl.[7] ..... F24F 13/24

[52] U.S. Cl. ..... 181/224; 181/225; 454/DIG. 906

[58] Field of Search ..... 454/337, 338, 454/DIG. 906; 181/225, 257, 268

[56] References Cited

U.S. PATENT DOCUMENTS

| | | | |
|---|---|---|---|
| 1,916,908 | 7/1933 | Stacey, Jr. et al. | 454/906 X |
| 4,319,521 | 3/1982 | Gorchev et al. | 181/224 X |
| 4,986,170 | 1/1991 | Ramakrishnan et al. | 454/906 X |

FOREIGN PATENT DOCUMENTS

| | | | |
|---|---|---|---|
| 1018084 | 1/1966 | United Kingdom | 181/224 |

*Primary Examiner*—Harold Joyce
*Attorney, Agent, or Firm*—McDermott, Will & Emery

[57] ABSTRACT

A compact air handling system includes an inlet channel which defines an inlet flow path in a first direction along a flow axis and a discharge channel which defines a discharge flow path in a second direction, opposite to the first direction along the flow axis. Air enters the air handling system through an inlet port and is discharged via an discharge port. The inlet channel is provided with acoustical buffering to attenuate inlet noise. The discharge channel is also provided with acoustical buffering in the form of a discharge silencer to attenuate noise in the discharge channel. An acoustical inlet plenum couples the inlet channel to the discharge channel. The cross-sectional area of the discharge channel adjacent the discharge port is larger than the cross-sectional area of the discharge channel adjacent the acoustical inlet plenum. If the inlet ports are not substantially equally distributed about the air handling system, a transfer passage can be provided between the inlet ports and the inlet channel to provide equalization of the air flow.

11 Claims, 3 Drawing Sheets

COMPACT AIR HANDLING UNIT WITH INTEGRAL SILENCING

CROSS-REFERENCE TO RELATED APPLICATIONS

This application is related to and takes priority from U.S. Patent and Trademark Office Provisional application No. 60/087,703, filed Jun. 2, 1998, which is incorporated herein by reference.

BACKGROUND OF THE INVENTION

This invention relates to heating, ventilating and air conditioning systems and, more particularly, to a noise reducing air handling system which is compact and efficient.

Air handling systems are used to provide large volumes of air, typically to commercial environments. One of the problems common to conventional air handling systems that are designed to move large volumes of air is the undesirable level of noise that is generated. To reduce the noise in prior art systems, additional noise reduction and attenuation components are added resulting in large or bulky and generally inefficient air handling systems.

Accordingly, it is an object of this invention to provide an improved air handling system.

It is another object of this invention to provide a compact, quiet and efficient air handling system.

SUMMARY OF THE INVENTION

An air handling system includes an acoustically lined plenum box having at least one inlet port and defining an inlet channel. The inlet channel extends from the inlet port to an acoustical inlet plenum and defines an inlet flow path in a first direction along a flow axis. The air handling system also includes a fan and an acoustically attenuating discharge silencer defining a discharge channel which extends from the acoustical inlet plenum to a discharge port. The discharge channel defines a discharge flow path in a second direction opposite to the first direction. The discharge silencer and discharge channel can be located substantially concentrically with respect to the plenum box and the inlet channel. The fan produces inlet airflow that enters the inlet port, travels in the first direction along the inlet flow path into the acoustic inlet plenum and produces the discharge airflow that draws air from the acoustic inlet plenum into the discharge channel and out the discharge port.

The inlet port can extend substantially continuously along the perimeter of the plenum box. Alternatively, a plurality of discrete inlet ports can be disposed about the perimeter of the plenum box. Where multiple discrete inlet ports are used, a transfer passage can be provided between the inlet ports and the inlet channel in order to equalize the airflow into the inlet channel.

The cross-sectional area of the discharge channel can transition from the fan diameter at a first end to a larger cross-sectional area at a second end adjacent the discharge port. The cross-sectional shape of the discharge channel can also transition to a round or polygonal shaped discharge opening in order to facilitate connection with commercial or residential duct work.

The fan can be adapted for rotating about a fan axis that extends substantially parallel to the discharge channel. The discharge channel can further include a central sound absorbing pod which extends from the fan along the fan axis. The central sound absorbing pod serves to reduce the impact noises behind the fan motor and to improve fan efficiency.

Both the inlet channel and the discharge channel can be provided with acoustic baffles to further attenuate sound generated by or carried with the inlet and/or discharge airflow. Optionally, the channel enclosing the fan can be lined with removable panels which provide further acoustical attenuation.

BRIEF DESCRIPTION OF THE DRAWINGS

The foregoing and other objects of this invention, the various features thereof, as well as the invention itself, may be more fully understood from the following description, when read together with the accompanying drawings in which.

DETAILED DESCRIPTION OF THE PREFERRED EMBODIMENTS

Figure 1:
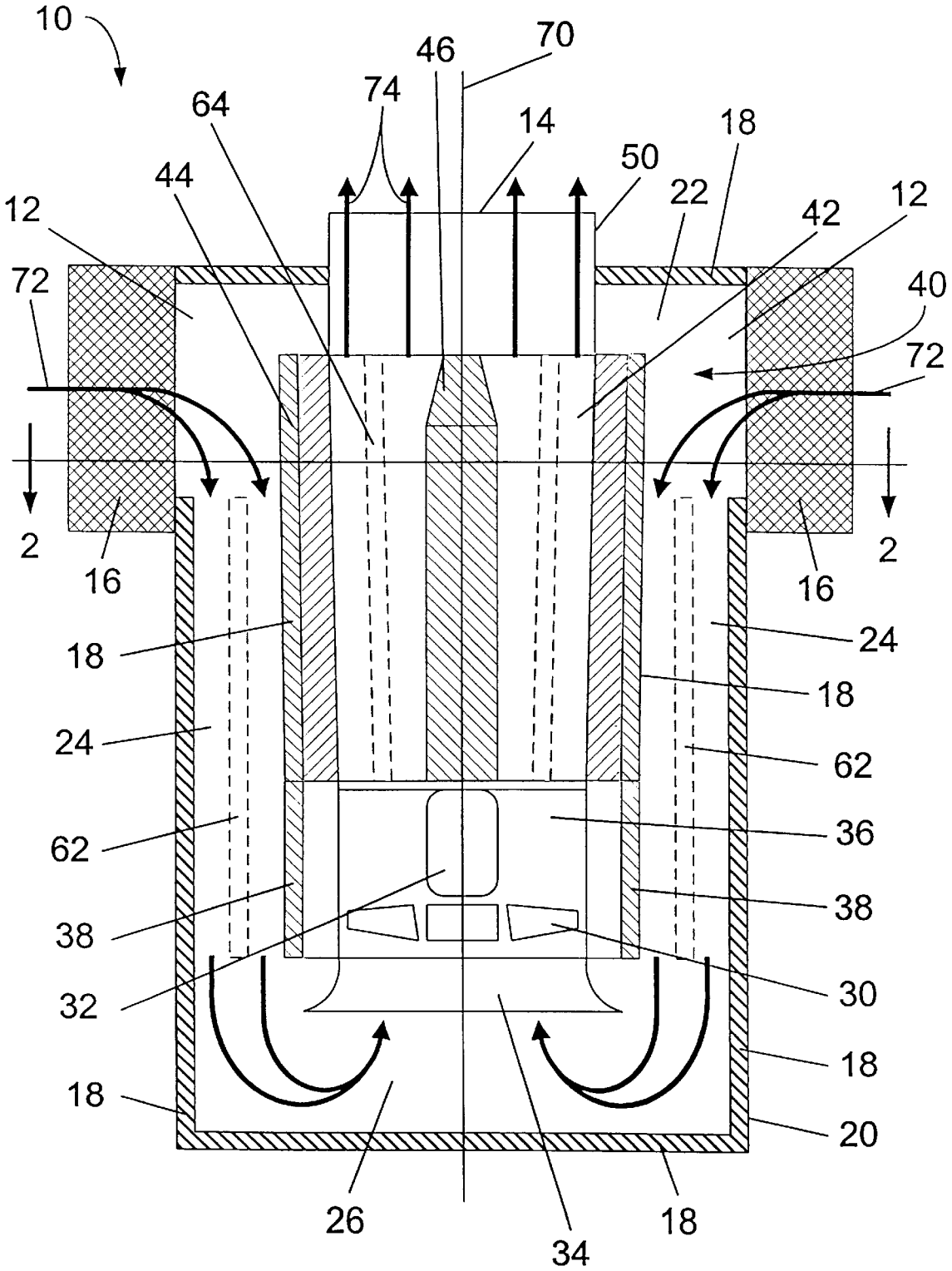
FIG. 1 is a diagrammatic view of an air handling system in accordance with the present invention.
Figure 2:
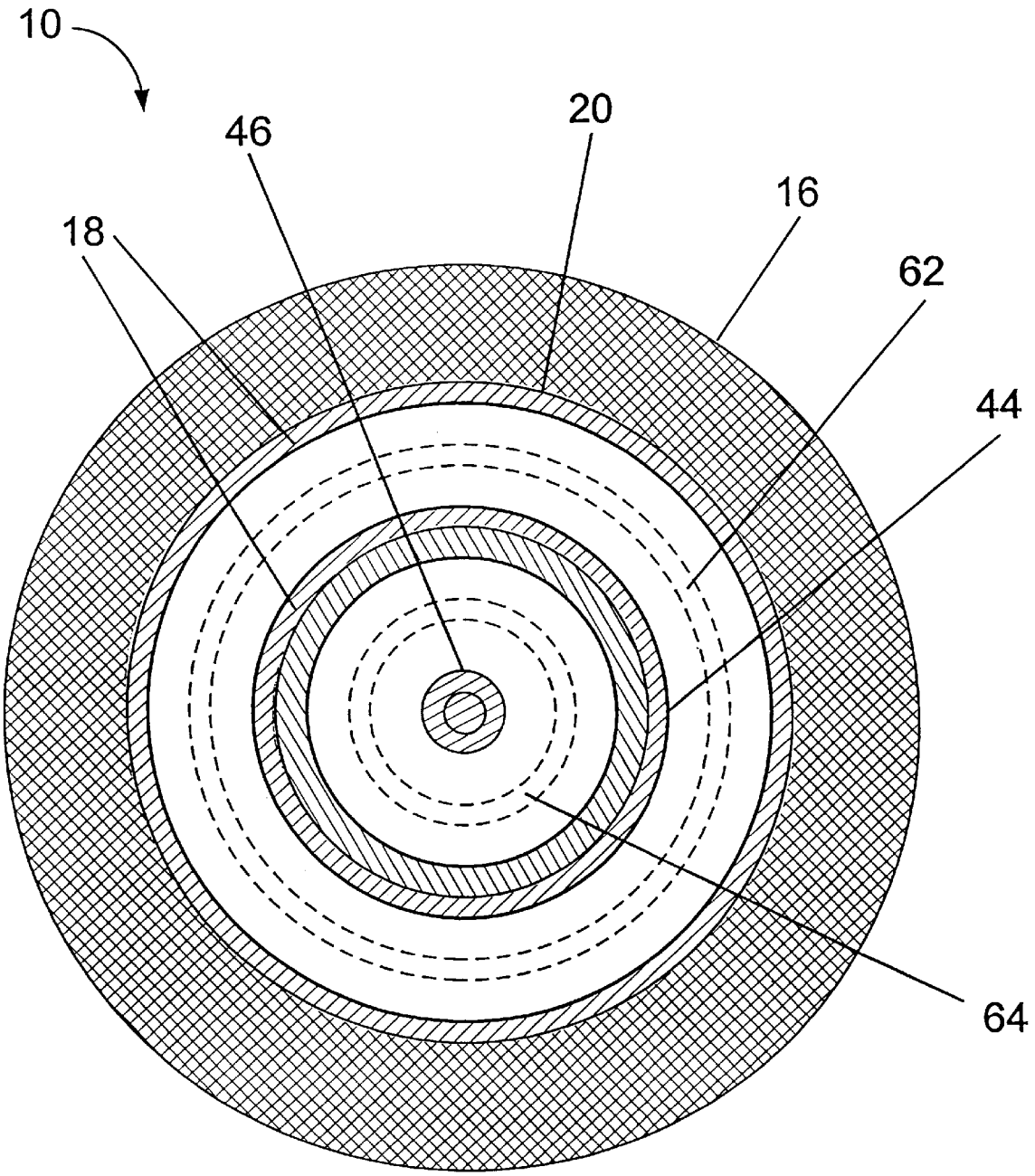
FIG. 2 is a diagrammatic view of a cross-section of the air handling system shown in FIG. 1.
Figure 3:
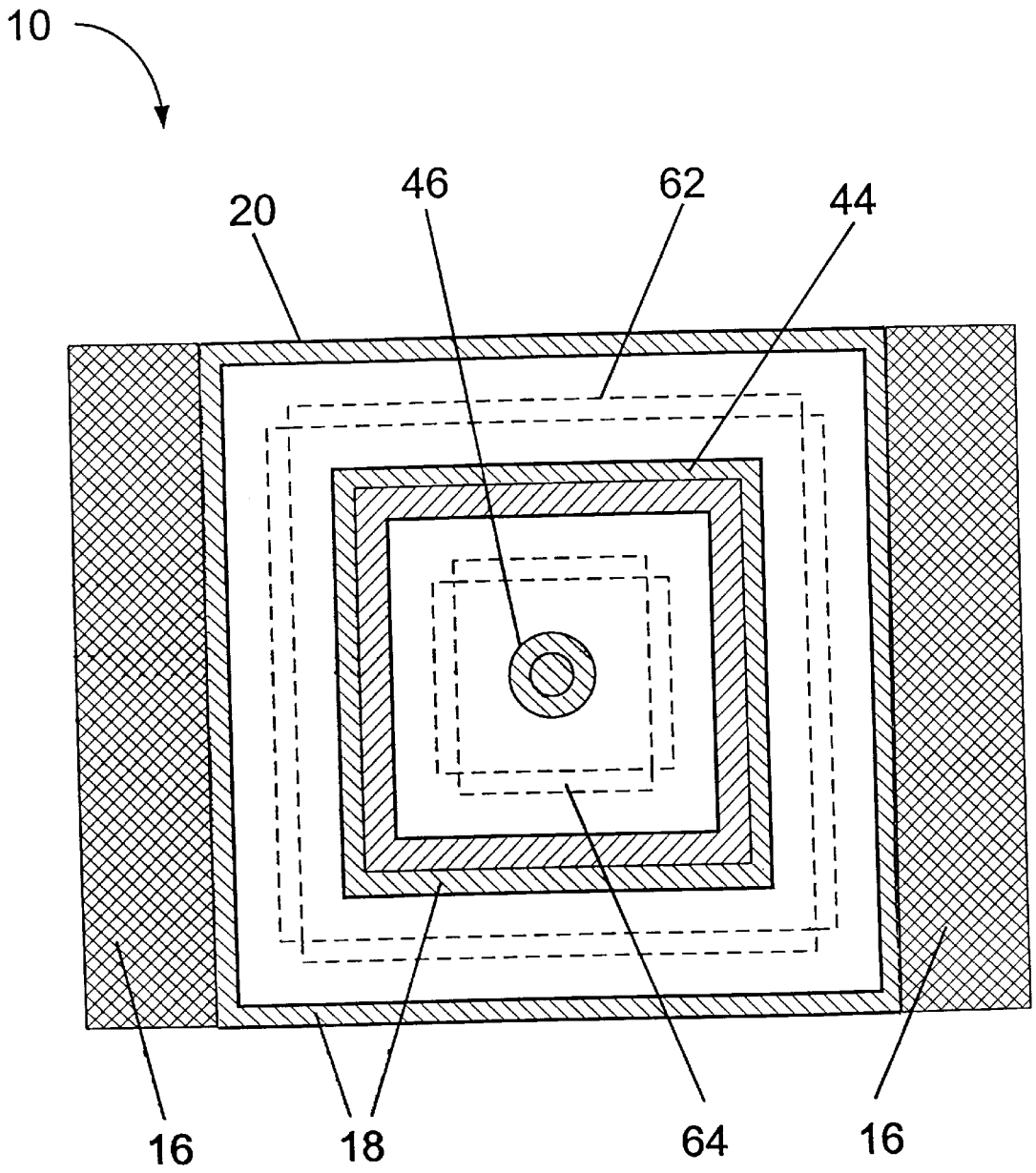
FIG. 3 is a diagrammatic view of an alternative cross-section of the air handling system shown in FIG. 1.

FIG. 1 shows an air handling system 10 according to the present invention. The air handling system 10 is constructed from an acoustically attenuating plenum box 20 having one or more air inlet ports 12 and one or more air discharge ports 14. Filters or coil boxes 16 can be disposed about the plenum inlet openings 12. Element 16, which is adjacent to inlet port 12, is a fluid (e.g., air) conditioner, which, for example, is capable of changing at least one characteristic (e.g., temperature or humidity) of an inlet fluid along an inlet flow path, such as characteristics of an air flow 72 entering inlet port 12. As shown in FIGS. 2 and 3, the plenum box 20 can have a round cross section or a polygonal (such as a square or rectangular) cross-section. In the case where the inlet port 12 does not extend continuously around the plenum box 20 or inlet ports 12 are not provided on all sides around the plenum box 20, a transfer passage 22 surrounding the outlet duct 50 is provided to equalize the air flow to the inlet channel 24. Inlet channel 24 can include intermediate baffles 62 to provide additional acoustical attenuation and/or to stabilize the inlet airflow. Alternatively, inlet channel 24 can include intermediate baffles (not shown) which divide the inlet channel 24 into a plurality of circumferentially spaced inlet channels. Inlet channel 24 feeds air to an acoustical inlet plenum 26.

The air handling system 10 also includes an externally lined discharge silencer 40 which includes a fan 30 and defines a discharge channel 42 extending from the acoustical inlet plenum 26 to the discharge port 14. As is shown in the cross-sectional views of FIGS. 2 and 3, viewing in the direction of arrows 2A and 2B, the discharge silencer 40 and the discharge channel 42 are disposed in substantially concentric relation with the plenum box 20 and the inlet channel 24. The exterior of the discharge silencer 40 and the interior walls of the plenum box 20 define the inlet channel 24 which approximates a hollow cylinder which is substantially concentrically arranged about the discharge silencer 40. The resulting airflow through the system 10 provides for an inlet airflow 72 through the inlet channel 24 that is in the opposite direction with respect to the discharge airflow 74 through the discharge channel 42 which flows in a direction substantially parallel to the central axis 70 of the discharge silencer 40 and the fan 30.

The acoustical inlet plenum 26 provides proper air flow to the fan inlet bell 34 of the discharge silencer 40. The fan 30 can be surrounded by acoustical baffles 38 to increase acoustical attenuation adjacent the inlet bell 34. Preferably, the discharge channel 42 transitions from a first diameter adjacent the fan to a larger diameter adjacent the discharge port 14, recovering by the Bernoulli effect most of the decrease in dynamic pressure as an increase in static pressure at the discharge port 14. A central sound absorbing pod 46, extending along the rotational axis of the fan 70 and extending from the fan motor 32, can be provided to reduce the impact losses behind the fan motor 32 and effectively improve fan 30 efficiency. Discharge channel 42 can include intermediate baffles 64 to provide additional sound attenuation and/or to stabilize the expanding airflow. Alternatively, discharge channel 42 can include intermediate baffles (not shown) which divide the discharge channel 42 into a plurality of circumferentially spaced discharge channels.

The air handling system 10 can be provided with one or more inlet ports 12. As shown in the cross-sectional view of FIG. 2, the air handling system 10 can include an inlet port 12 that extends continuously around the circumference of the system 10. Alternatively, as shown in the cross-sectional view of FIG. 3, the air handling system can include an inlet port 12 having a polygonal cross-section. Regardless of whether the air handling system has a round or polygonal cross-section, the system 10 can be provided with a plurality of discrete inlet ports 12 that are distributed around the perimeter of the plenum box 20 and separated by areas that do not permit air to enter the plenum box 20. As one of ordinary skill will appreciate, it is not necessary for each side to be provided with an inlet port 12. A transfer passage 22 can be provided between the inlet ports 12 and the inlet channel 24 in order to equalize the airflow into the inlet channel 24.

The dimensions of the plenum box 20 are determined so that the space between the discharge silencer lining 44 and lined plenum walls, together with the inlet plenum 26 volume provide the required inlet acoustical attenuation and permit proper airflow to the fan. As one of ordinary skill will appreciate, the relative volumes of the inlet channel 24, the acoustical inlet plenum 26 and the discharge channel 42 are selected to provide the necessary volume, velocity and acoustical attenuation as a function of the intended use of the system 10. In one preferred embodiment, the plenum box 20 is approximately 48 inches in diameter (or 78 in. by 78 in., if square) and approximately 108 in. high; the discharge channel transitions from approximately 32 in. in diameter at fan 30 to approximately 36 in. by 36 in. square at the discharge port; and the width of the inlet channel (i.e. the space between the discharge silencer and the acoustically lined plenum box walls) is approximately 5 in. If needed, the transfer passage surrounds the outlet duct 50 and extends approximately 5 in. above the discharge silencer.

Preferably, the fan 30 and motor 32 are selected to permit the air handling system to move 20,000 cubic feet per minute (cfm) of air flow with a pressure loss through the system that are less than 10% of conventional air handling systems. Not only is the air handling system of the present invention compact, one half to one quarter of the length of a conventional system, but also the air handling system of the present invention is more efficient than the prior art system by providing more cfm per unit energy consumed.

The acoustical buffering provides sound and/or noise attenuation to reduce noise associated with airflow as well as fan noise. Methods of attenuating sound in airflow channels are well known. In the preferred embodiment, the plenum box 20 can be lined with sound absorbing material 18 and the discharge silencer 40 is lined with sound absorbing material 48. Preferably, the sound absorbing material 18 and/or 48 is 2½ to 3 lb. density fiberglass duct-liner or batts.

The description discloses an example of an embodiment of the invention that is effective for use in air handling systems, however as a person having ordinary skill in the art will appreciate, the invention can be embodied in systems for use in other fluid handling systems such as systems which handle other gases or liquids.

The invention may be embodied in other specific forms without departing from the spirit or essential characteristics thereof. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein.

What is claimed is:

1. An air handling system for establishing air flow along a discharge axis, comprising:

A. at least one inlet port for receiving air flow along an inlet axis transverse to said discharge axis;

B. an inlet channel extending between said inlet port and an inlet plenum, said inlet channel defining an inlet flow path in a first direction along a flow axis from said inlet port to said inlet plenum, said flow axis being parallel to said discharge axis;

C. an acoustically buffered discharge channel extending between said inlet plenum at a first end of said discharge channel and a discharge port at a second end of said discharge channel, said inlet channel being substantially disposed about and concentric with said discharge channel and said discharge channel defining a discharge flow path extending along said discharge axis in a direction opposite to said first direction from said inlet plenum to said discharge port; and D. a fan disposed in said discharge flow path adjacent said inlet plenum, and capable of establishing air flow from said inlet plenum to said discharge channel and out from said discharge port along said discharge flow path.

2. An air handling system according to claim 1 further comprising a transfer passage, coupling said inlet port to said at least one inlet channel, adapted for equalizing fluid flow from said inlet port to said at least one inlet channel.

3. An air handling system according to claim 1 wherein said at least one discharge channel is characterized by a first cross-sectional area adjacent said first end and a second cross-sectional area adjacent said second end and said second cross-sectional area is greater than said first cross-sectional area.

4. An air handling system according to claim 3 wherein said second cross-sectional area is formed in a different shape than said first cross-sectional area.

5. An air handling system according to claim 1 further comprising acoustic baffles disposed in said at least one inlet channel.

6. An air handling system according to claim 1 further comprising acoustic baffles disposed in said at least one discharge channel.

7. An air handling system according to claim 1 further comprising at least one filter disposed adjacent said at least one inlet port in said inlet flow path.

8. An air handling system according to claim 1 further comprising a fluid conditioner, disposed adjacent said at least one inlet port in said inlet flow path, and capable of changing at least one characteristic of a fluid flowing in said inlet flow path.

9. An air handling system according to claim 8 wherein said fluid conditioner changes a temperature characteristic of a fluid flowing in said inlet flow path.

10. An air handling system according to claim 8 wherein said fluid conditioner changes a humidity characteristic of a fluid flowing in said inlet flow path.

11. An air handling system according to claim 1 wherein said fan means includes a rotary fan adapted for rotating about a fan axis and a central sound absorbing pod extending along said fan axis into said at least one discharge channel.

* * * * *